US009500994B2

(12) United States Patent
Brown et al.

(10) Patent No.: US 9,500,994 B2
(45) Date of Patent: Nov. 22, 2016

(54) DEVELOPER UNIT ARCHITECTURE FOR AN IMAGING DEVICE

(75) Inventors: Stephen Andrew Brown, Lyndhurst, OH (US); James Anthany Carter, Lexington, KY (US); Gregory Alan Cavill, Winchester, KY (US); Matthew David Heid, Simpsonville, KY (US); Benjamin Keith Newman, Lexington, KY (US); Joshua Carl Poterjoy, Georgetown, KY (US); Matthew Russell Smither, Lexington, KY (US); Christopher G. Vowels, Versallies, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 227 days.

(21) Appl. No.: 13/468,109

(22) Filed: May 10, 2012

(65) Prior Publication Data

US 2013/0170876 A1 Jul. 4, 2013

Related U.S. Application Data

(63) Continuation-in-part of application No. 13/340,789, filed on Dec. 30, 2011, now Pat. No. 8,718,496.

(60) Provisional application No. 61/612,946, filed on Mar. 19, 2012.

(51) Int. Cl.
*G03G 15/08* (2006.01)

(52) U.S. Cl.
CPC ..... *G03G 15/0898* (2013.01); *G03G 15/0812* (2013.01)

(58) Field of Classification Search
CPC ..... G03G 15/0898; G03G 15/0812
USPC ..... 399/284
See application file for complete search history.

(56) References Cited

U.S. PATENT DOCUMENTS

| | | | | |
|---|---|---|---|---|
| 7,359,662 | B2 * | 4/2008 | Yamada et al. | 399/284 |
| 2002/0150402 | A1 | 10/2002 | Buchanan et al. | |
| 2003/0180061 | A1 | 9/2003 | Oguma et al. | |

(Continued)

FOREIGN PATENT DOCUMENTS

| | | |
|---|---|---|
| JP | 2003-323037 | 11/2003 |

OTHER PUBLICATIONS

Patent Cooperation Treaty (PCT), International Search Report and Written Opinion for PCT Application PCT/US12/72084, Mar. 19, 2013.

(Continued)

*Primary Examiner* — Walter L Lindsay, Jr.
*Assistant Examiner* — Philip Marcus T Fadul

(57) ABSTRACT

A removable unit for an electrophotographic imaging device includes a housing having an opening, a rotatable roll disposed near the opening and adjacent to a bottom of the housing and a blade assembly coupled to the housing. The blade assembly includes a support bracket secured to a wall defining at least a part of the opening of the housing, and a blade member coupled to the support bracket and being positioned in the removable unit so that a distal end portion of the blade member engages with the rotatable roll. The housing, the blade assembly, and a portion of a surface of the rotatable roll define a substantially sealed enclosure for containing toner therein.

25 Claims, 5 Drawing Sheets

(56) References Cited

U.S. PATENT DOCUMENTS

| | | | | |
|---|---|---|---|---|
| 2004/0120734 | A1* | 6/2004 | Okamoto | G03G 15/0812 399/284 |
| 2005/0069357 | A1 | 3/2005 | Kabata et al. | |
| 2006/0263117 | A1* | 11/2006 | Kim et al. | 399/284 |
| 2007/0116491 | A1 | 5/2007 | Park et al. | |
| 2007/0206965 | A1 | 9/2007 | Namiki et al. | |
| 2008/0025766 | A1* | 1/2008 | Fukuta | 399/284 |
| 2008/0181659 | A1 | 7/2008 | Noh | |
| 2009/0154950 | A1 | 6/2009 | Kant et al. | |
| 2011/0222939 | A1 | 9/2011 | Gibson et al. | |
| 2011/0249983 | A1 | 10/2011 | Perez et al. | |
| 2014/0169827 | A1* | 6/2014 | Hattori et al. | 399/106 |

OTHER PUBLICATIONS

Patent Cooperation Treaty International Preliminary Report on Patentability for PCT application PCT/US12/72084, Jul. 1, 2014.

Extended European Search Report for EP patent application 12863642.0, European Patent Office, Aug. 27, 2015.

* cited by examiner

DEVELOPER UNIT ARCHITECTURE FOR AN IMAGING DEVICE

CROSS REFERENCES TO RELATED APPLICATIONS

The present application is a continuation-in-part application and claims benefit from U.S. patent application Ser. No. 13/340,789, filed Dec. 30, 2011, now U.S. Pat. No. 8,718,496 entitled, "Capacitive Toner Level Sensor," the content of which is hereby incorporated by reference herein in its entirety.

Pursuant to 35 U.S.C. §119, this application claims the benefit of the earlier filing date of Provisional Application Ser. No. 61/612,946, filed Mar. 19, 2012, entitled "Developer Unit Architecture for an Imaging Device," the content of which is hereby incorporated by reference herein in its entirety.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to electrophotographic image forming devices such as a printer or multifunction device having printing capability, and in particular to a developer unit assembly architecture therefor.

2. Description of the Related Art

Laser printers utilize a light beam which is focused to expose a discrete portion of a photoreceptive or image transfer drum in a further attempt to attract printing toner to these discrete portions. This photoconductive drum assembly is made out of highly photoconductive material that is discharged by light photons typically embodied by a laser. Initially, the drum is given a charge by a charge roller. As the photoreceptive drum revolves, the printer shines a laser beam across the surface to discharge certain points. In this way, the laser "draws" the letters and images to be printed as a pattern of electrical charges—an electrostatic latent image. The system can also work with either a more positively charged electrostatic latent image on more negatively charged background or a more negative charged electrostatic latent image on a more positively charged background.

When the toner becomes electrostatically charged, the toner is attracted to exposed portions of the image transfer roller. After the data image pattern is set, charged toner is supplied to the photoconductive drum. Because of the charge differential between the discharged areas on the photoconductive drum and the charged toner, the toner is attracted to and clings to the discharged areas of the drum, but not to the similarly charged "background" portions of the photoconductive drum. With the toner pattern on the photoconductive drum, the drum engages a sheet of paper or other media moving adjacent thereto. The paper or other media may be driven by a transport belt or transfer roller, which is oppositely charged to the toner causing it to transfer to the paper or other media. This charge is stronger than the charge of the electrostatic image, so the transfer roller pulls the toner away from the surface of the photoconductive drum. When the media passes beneath the rotating photoconductive drum, the toned image is transferred to the media. The transferred toner is subsequently fused to the paper typically by application of heat and pressure.

In order to reduce the premature replacement of components traditionally housed within a toner cartridge for an image forming device, toner cartridge manufacturers have begun to arrange components having a longer life and those having a shorter life into separate replaceable units. Relatively longer life components such as a developer roll, a toner adder roll, a doctor blade and a photoconductive drum are, in some imaging architectures, positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit within the imaging device. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

To deliver toner from the toner cartridge to the imaging unit, an auger in the toner cartridge may be used to feed toner from an exit port on the toner cartridge into an entrance port on the imaging unit and in proximity with a second auger that disperses the toner within the imaging unit. A developer roll is a charged rotating roller, typically with a conductive metal shaft and a polymeric conductive coating, which receives toner from a toner adder roll positioned adjacent the developer roll. Due to the electrical charge and mechanical scrubbing, the developer roll collects toner particles from the toner adder roll. A doctor blade assembly engages the developer roll to provide a consistent coating of toner along the length and surface of developer roll, by scraping or "doctoring" excess toner from the developer roll and metering a thin layer of toner on the developer roll surface. In turn, this provides a consistent coating of toner to the photoconductive drum. Without a doctor blade, the coating of toner on the developer roll may be inconsistent, too thick, too thin or bare, thereby causing the amount of toner presented to the latent image of the photoconductive drum to be inconsistent and the level of darkness of the printed image may vary as a result, which is considered a print defect.

One challenge with existing imaging units is that of providing a consistent, cost effective and space saving seal generally around the location where the doctor blade assembly and the imaging unit housing meet due to the tolerances and stiffness of the seal utilized in this location. Accordingly, it would be desirable to inhibit toner leakage in the imaging unit housing without adding additional parts or increasing expense through additional components to seal this area.

SUMMARY

A removable unit for an electrophotographic imaging device includes a housing having an opening, a rotatable roll disposed near the opening and adjacent to a bottom of the housing, and a blade assembly coupled to the housing. The blade assembly includes a support bracket secured to a wall defining at least a part of the opening of the housing, and a blade member coupled to the support bracket and being positioned in the removable unit so that a distal end portion of the blade member engages with the rotatable roll. The housing, the blade assembly, and a portion of a surface of the rotatable roll define an enclosure for containing toner therein.

In an example embodiment, the support bracket further includes a top ledge contacting a top portion of the housing. The blade member extends substantially from the top ledge of the support bracket to the distal end portion of the blade member, thereby providing a continuous, substantially smooth surface for enclosing the housing.

The support bracket may include a first surface against which the blade member is coupled, and wherein the distal end portion of the blade member bends or flexes away from a lower portion of the first surface due to engagement with the rotatable roll. The blade member has a width between a first end and a second end thereof, and a cantilever length which varies along the width, the cantilever length of the blade member being a distance between an attachment point of the blade member to the support bracket and the distal end of the blade member. The blade member and support bracket may be welded together at a plurality of weld locations forming a weld pattern along the blade member and support bracket, the weld pattern providing a varying cantilever length of the blade member along the width thereof.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
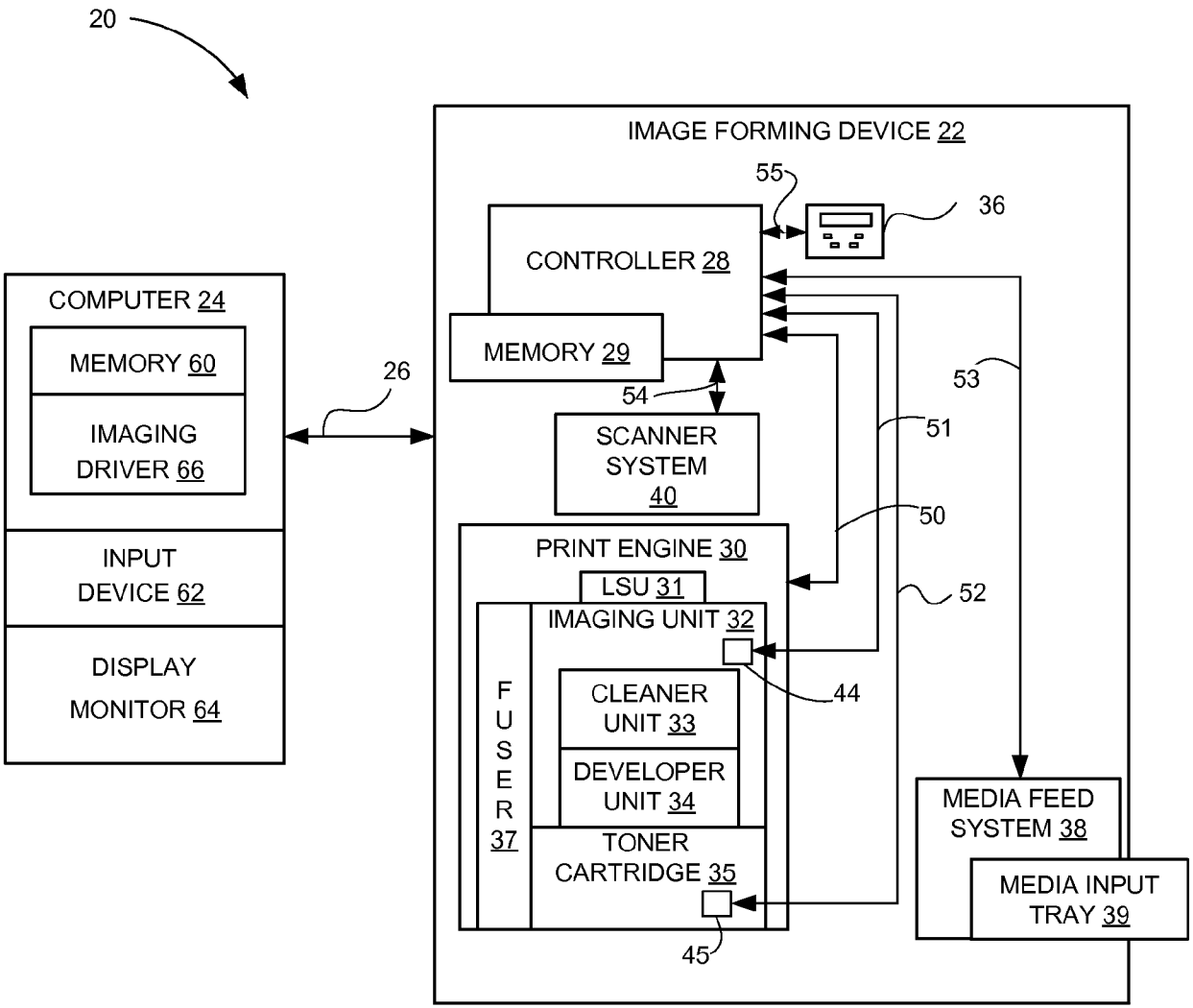
FIG. 1 is a block diagram of an example imaging system utilizing the imaging unit of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a diagrammatic depiction of an imaging system 20 embodying the present disclosure. As shown, imaging system 20 may include an imaging apparatus 22 and a computer 24. Imaging apparatus 22 communicates with computer 24 via a communications link 26. As used herein, the term "communications link" is used to generally refer to any structure that facilitates electronic communication between multiple components, and may operate using wired or wireless technology and may include communications over the Internet.

In the embodiment shown in FIG. 1, imaging apparatus 22 is shown as a multifunction machine that includes a controller 28, a print engine 30, a laser scan unit (LSU) 31, an imaging unit 32 having a developer unit 34, a toner cartridge 35, a user interface 36, a media feed system 38 and media input tray 39, and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40 or a standalone scanner system 40.

Controller 28 includes a processor unit and associated memory 29, and may be implemented as one or more Application Specific Integrated Circuits (ASICs). Memory 29 may be any volatile and/or non-volatile memory such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuit 44, 45 may provide authentication functions, safety and operational interlocks, operating parameters and usage information related to imaging unit 32 and toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, electronic tablet, smartphone or other hand-held electronic device, including memory 60, such as volatile and/or non-volatile memory, an input device 62, such as a keyboard or keypad, and a display monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include laser scan unit (LSU) 31, imaging unit 32, and a fuser 37, all mounted within imaging apparatus 22. The imaging unit 32 further includes a cleaner unit 33 housing a waste toner removal system and a photoconductive drum, and developer unit 34. Imaging unit 32 is removably mounted within print engine 30 of imaging apparatus 22. In one embodiment, the cleaner unit 33 and developer unit 34 are assembled together and installed onto a frame of the imaging unit 32. The toner cartridge 35 is then installed on or in proximity with the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 39 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

Figure 2:
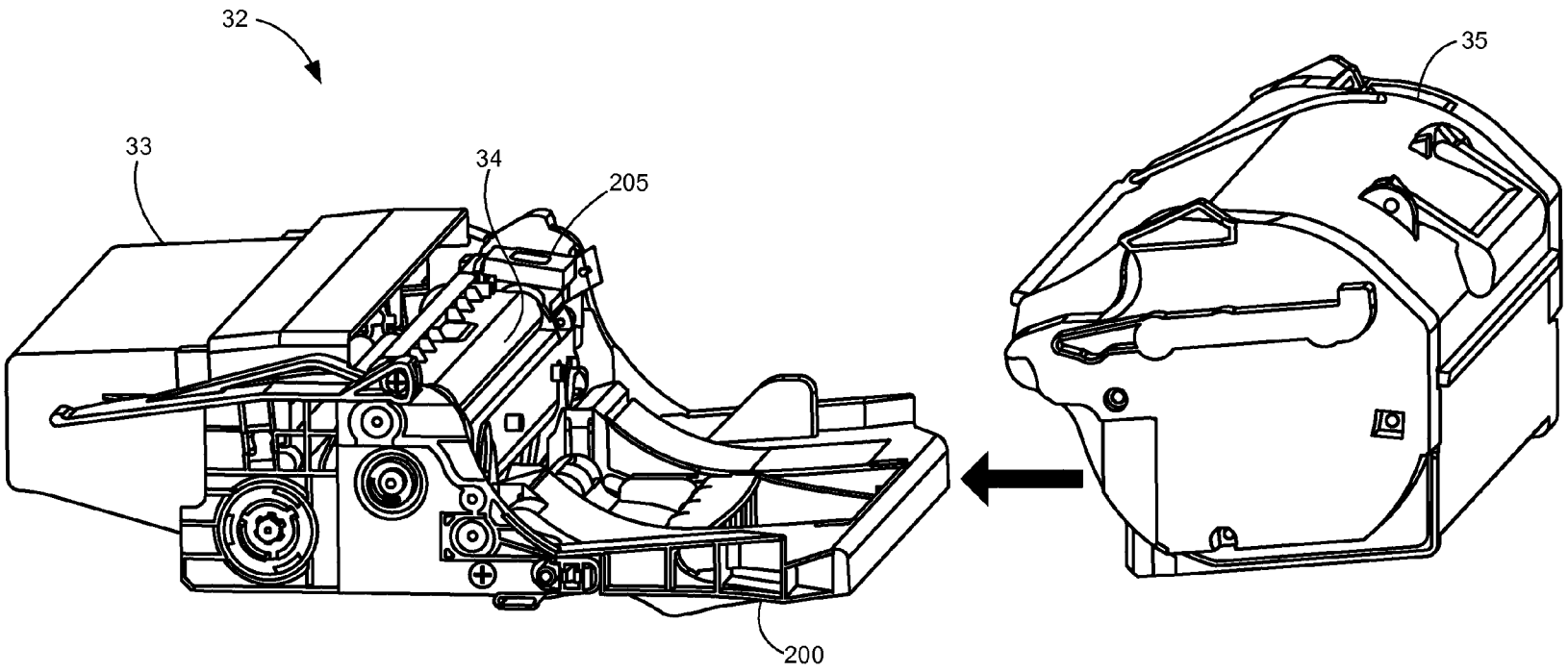
FIG. 2 is a perspective view of an imaging unit and toner cartridge of FIG. 1 in accordance with an example embodiment.

Referring now to FIG. 2, an example embodiment of imaging unit 32 is shown. Imaging unit 32, as illustrated, includes developer unit 34, cleaner unit 33 and a frame 200. Developer unit 34 and cleaner unit 33 are assembled onto or otherwise secured to frame 200. The imaging unit 32 without toner cartridge 35 is initially slidably received into imaging apparatus 22. The toner cartridge 35 is then slidingly inserted along frame 200 until it is operatively coupled to developer unit 34. This arrangement allows toner cartridge 35 to be separately removed and reinserted easily when replacing an empty toner cartridge or during media jam removal. The developer unit 34, cleaning unit 33 and frame 200 may also be readily slidingly removed and reinserted as a single unit when required. However, this would normally occur with less frequency than the removal and reinsertion of toner cartridge 35.

As mentioned, the toner cartridge 35 removably mates with the developer unit 34 of imaging unit 32. An exit port (not shown) on the toner cartridge 35 communicates with an inlet port 205 on the developer unit 34 allowing toner to be periodically transferred from the toner cartridge 35 to resupply the toner sump in the developer unit 34. It is understood, in an alternative embodiment, that imaging unit 32 and toner cartridge 35 may be formed as a single replaceable unit. It is further understood in another alternative embodiment that cleaner unit 33, having the photoconductive drum, and developer unit 34 may be separate components and as such be separately removable from imaging apparatus 22. In this way, features of developer unit 34 described below may be utilized in developer units corresponding to different imaging unit architectures and are not limited to the particular imaging unit architecture described herein.

Figure 3:
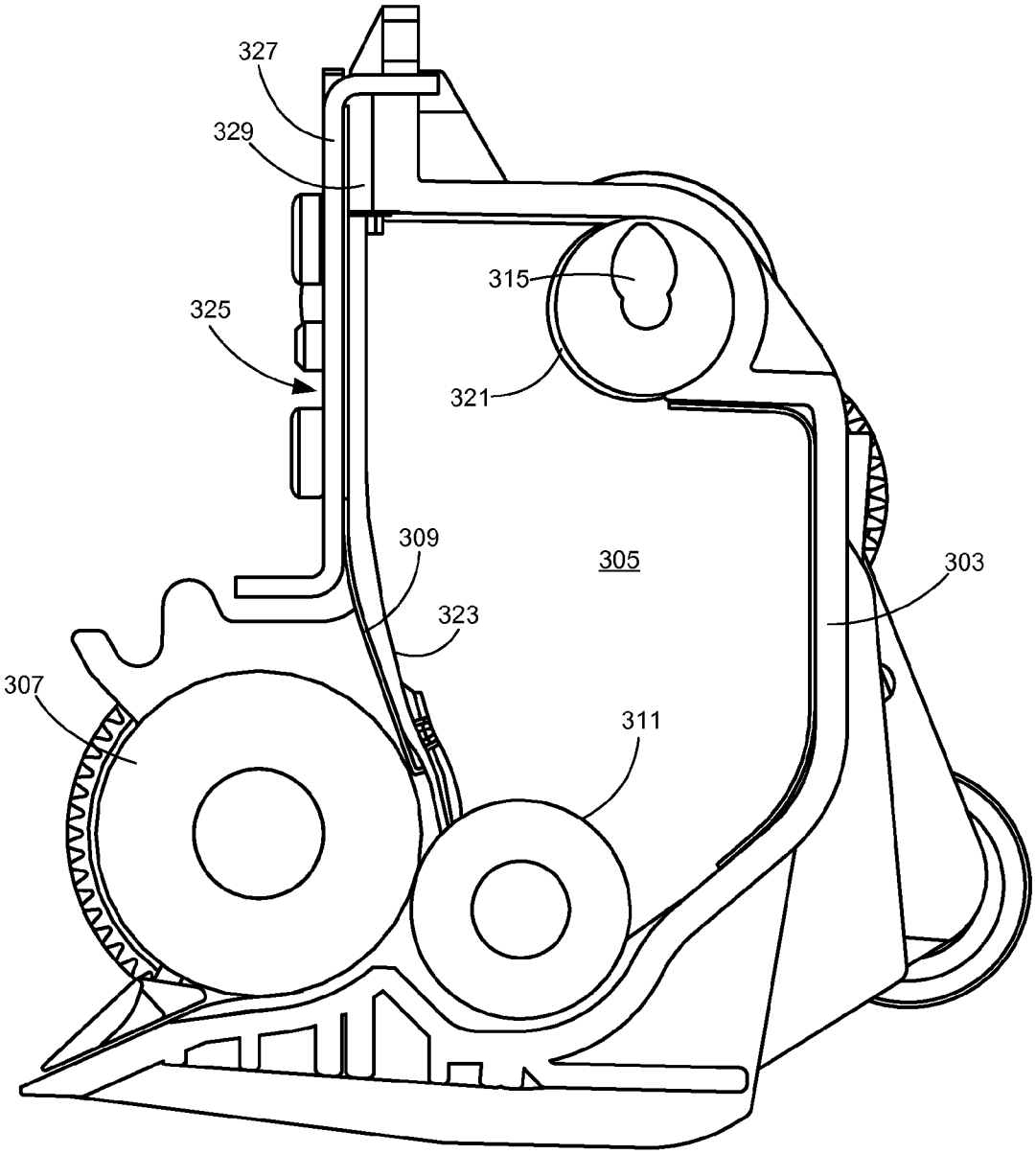
FIG. 3 is a cross-sectional view of the developer unit of the imaging unit in FIG. 2 according to an example embodiment.

Referring now to FIG. 3, an example embodiment of the developer unit 34 is shown. Developer unit 34 includes a housing 303 enclosing a toner sump 305 sized to hold a quantity of toner. A developer roll 307, a doctor blade assembly 325 including a doctor blade 309, and a toner adder roll 311 may be mounted within toner sump 305. The toner adder roll 311 moves the toner supplied from the toner cartridge 35 to developer roll 307 while the doctor blade 309 provides a metered, uniform layer of toner on developer roll 307. A rotating auger 315 and gutter 321 may be disposed along a side of the toner sump 305 proximal to toner inlet port 205 (shown in FIG. 2) so as to distribute incoming toner evenly across toner sump 305. A rotatable toner paddle or toner agitator (not shown) having one or more blades may be positioned within toner sump 305 to stir and move toner towards toner adder roll 311 and developer roll 307. In stirring and moving toner, the rotating toner agitator prevents toner particles from forming larger clumps within toner sump 305.

Referring to FIGS. 2 and 3, toner inlet port 205 on housing 303 aligns with the exit port of toner cartridge 35 when toner cartridge 35 is installed along frame 200 and mated with developer unit 34. In one example form, toner inlet port 205 may be larger in area than the exit port of toner cartridge 35.

Doctor blade 309 is disposed along and engages with developer roll 307 to provide a substantially uniform layer of toner thereon for subsequent transfer to a latent image on photoconductive drum in imaging unit 32. In order to prevent toner leakage, a seal member 323 is disposed along each end of developer unit 34. Each seal member 323 engages with and, in some embodiments, at least partly wraps around a longitudinal end portion of developer roll 307. To fully contain toner within developer unit 34, seal members 323 also contact doctor blade 309 at its longitudinal ends. It is understood that each of seals 323 may be implemented in a number of ways. For instance, each seal 323 may be implemented using more than one seal member which, when disposed along a side of housing 303 of developer unit 34, engage with doctor blade 309, developer roll 307 and/or each other so as to form a seal along the side of housing 303.

Seal members 323 prevent toner leakage through contact with doctor blade 309 and developer roll 307. A doctor blade seal 329 is provided between the doctor blade assembly 325 and the housing 303 to prevent toner leakage along the interface between the doctor blade assembly 325 and the housing 303.

Figure 4:
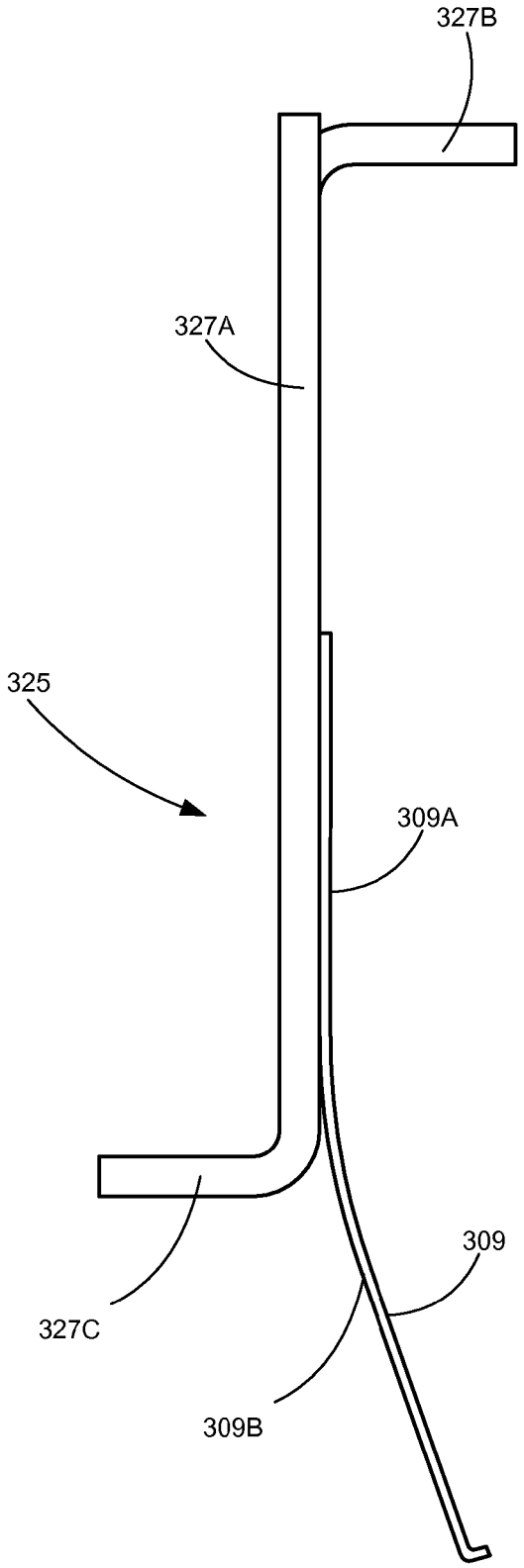
FIG. 4 is a side elevational view of the doctor blade assembly of the developer unit of FIG. 3.

With respect to FIG. 4, there is shown a doctor blade assembly 325 according to an example embodiment. Doctor blade assembly 325 includes a support bracket 327 to which doctor blade 309 is secured. According to an example embodiment, the doctor blade 309 is welded to the support bracket 327. It may be appreciated that any suitable welding process may be used, such as, for example, spot welding. However, support bracket 327 alternatively may be connected to the doctor blade 309 by a fixative such as epoxy, cement, glue or the like. Support bracket 327 includes apertures located along each longitudinal end portion for securing to housing 303 of developer unit 34 via screws or the like. At least one of the apertures may be oval in shape so as to provide for lateral adjustment of the doctor blade assembly 325 during assembly. Support bracket 327 is generally a stiff material such as steel and generally rectangular in shape extending from one side of the housing 303 to an opposed side thereof. When mounted over an opening defined on the front of housing 303 of developer unit 34, doctor blade assembly 325 cooperates with housing 303, developer roll 307 and seals 323 and seals which wrap at least partly around ends of developer roll 307 to define a sealed toner sump 305. The use of doctor blade assembly 325 to form a portion of the sealed toner sump 305 eliminates the need to include a second piece plastic welded on the housing 303, as well as permits housing 303 to be formed from a single mold.

Referring again to FIG. 4, support bracket 327 may include a substantially planar portion 327A to which doctor blade 309 is secured. An upper area of substantially planar portion 327A sealingly contacts housing 303 when doctor blade assembly 325 is connected thereto. Support bracket 327 may further include a top ledge 327B and a bottom ledge 327C, which extends from a lower end portion of substantially planar portion 327A in a generally opposite direction from the direction top ledge 327B extends from planar surface portion 327A. A distal end portion of the doctor blade 309 bends or flexes away from a lower portion of portion 327A of support bracket 327 due to engagement with the developer roll 307, as shown in FIG. 3.

In an example embodiment, each ledge 327B and 327C may form an approximately 90 degree angle with substantially planar portion 327A. It is understood that, alternatively, ledges 327B and 327C may extend from substantially planar portion 327A at angles other than 90 degrees, and may extend at angles that are different from each other. The use of ledges 327B and 327C strengthens the developer unit 34 with the support bracket 327 providing most of the rigidity thereto. It can be appreciated that support bracket 327 may have additional stiffening features such as beads formed on the substantially planar portion 327A.

The upper area of substantially planar portion 327A of the support bracket 327 engages an upper surface of the doctor blade seal 329, so as to capture the doctor blade seal 329 between the doctor blade assembly 325 and the housing 303. Distal end portions of the doctor blade seal 329 have cut-out portions (not shown) sized to accommodate upper ends of the seal members 323. The doctor blade seal 329 extends between the ends in a direction along the upper edge of the opening formed by housing 303. The doctor blade seal 329 may be formed of a foam material to act as deformable seal between the doctor blade assembly 325 and the housing 303. In the example embodiment, the doctor blade seal is adhered to an upper rim portion of housing 303. During assembly, the doctor blade assembly 325 is tightened against the housing 303 thereby compressing the doctor blade seal 329 such that leakage is reduced. Additionally, the upper area of substantially planar portion 327A of the support bracket 327 engages the upper edge surface of the doctor blade seal 329 thereby improving sealing along the interface between the doctor blade seal 329 and the doctor blade assembly 325.

FIGS. 5-8 illustrate doctor blade 309 according to various example embodiments. The doctor blade 309 is generally rectangular in shape having an elongated width-wise dimension that extends the width of housing 303. Doctor blade 309 may include tabs 503, 505, each of which is disposed at an end thereof. Each of tabs 503, 505 may align with an aperture located on support bracket 327 for receiving an alignment feature extending from housing 303. The doctor blade 309 includes a front surface 309A and a rear surface 309B. The doctor blade 309 is substantially planar in its natural state, but in order to provide a "doctoring" force on the developer roll 307 it undergoes a slight curvature due to interference with the developer roll 307 upon installation. The distal edge of the doctor blade 309 may include a bend, as shown in FIG. 3. The doctor blade 309 extends substantially from the top ledge 327B of support bracket 327 toward a peripheral surface of the developer roll 307 in order to scrape excess toner from the outer surface of the developer roll 307. Since the interface between the housing 303 defining toner sump 305 and the doctor blade assembly 325 is for the most part the front surface 309A of the doctor blade 309, the possibility of toner leaks is reduced. According to the exemplary embodiment, the doctor blade 309 may be formed of phosphor bronze to provide the desired elasticity and electrical conductivity. Alternatively, doctor blade 309 may be formed a hardened stainless steel to provide a desired elasticity and also withstand corrosion which might damage the developer roll 307. It is understood, though, that other materials may be utilized.

Figure 5:
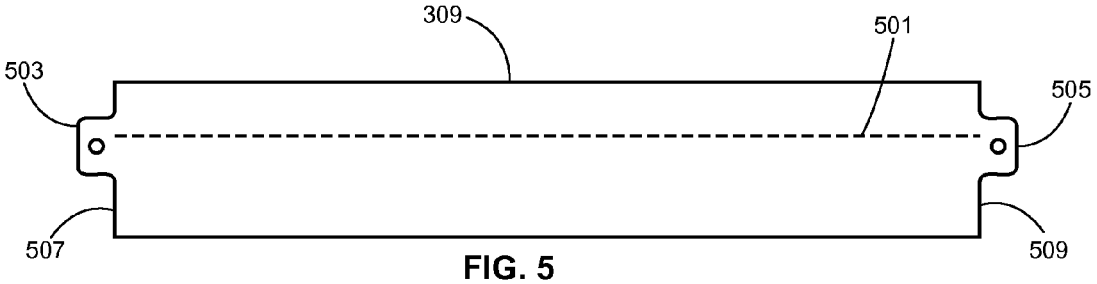
FIG. 5 is a front view of a doctor blade of the doctor blade assembly of FIG. 4 according to an example embodiment, showing a weld pattern thereon.
Figure 7:
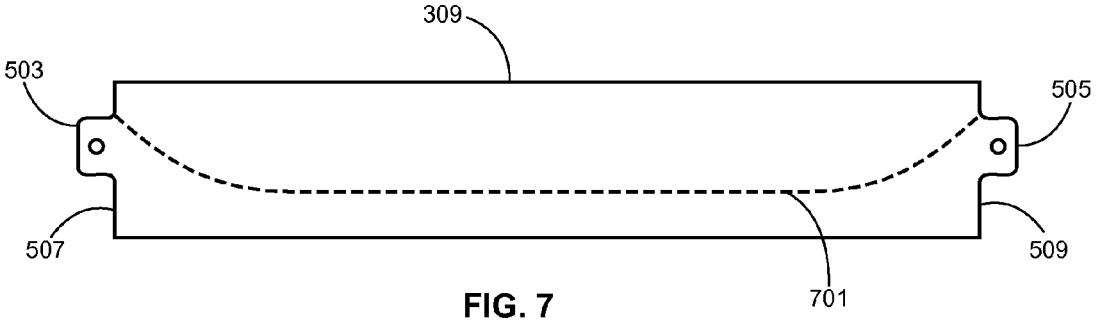
FIG. 7 is a front view a doctor blade showing a weld pattern according to an alternative example embodiment.
Figure 8:
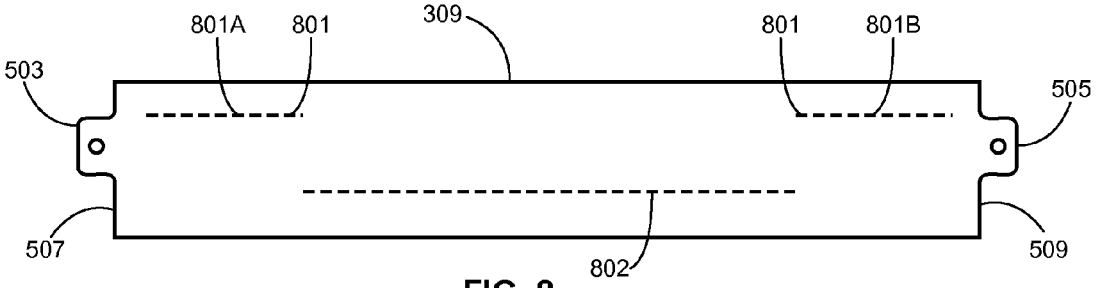
FIG. 8 is a front view a doctor blade showing a weld pattern according to another alternative example embodiment.

As mentioned above, the doctor blade 309 may be welded to support bracket 327. FIGS. 5, 7, and 8 show different spot weld patterns for securing doctor blade 309 to support bracket 327. With reference to FIG. 5, there is shown a substantially linear, horizontal weld pattern 501 having welds substantially evenly spaced and centrally disposed on the doctor blade 309. Weld pattern 501 may extend between tabs 503, 505. In an example embodiment, the spacing between welds may be about 10 millimeters and the distance from the first weld to end 507 may be about 2 millimeters. By positioning the doctor blade assembly 325 within developer unit 34 so that the distal end portion of doctor blade 309 bends away from support bracket 327, the doctor blade 309 is cantilevered from the weld pattern 501, in contrast to the distal end portion of doctor blade 309 being cantilevered from the end of the support bracket 327 if the doctor blade assembly 325 is mounted to housing 303 such that bottom ledge 327C extends towards toner sump 305 from planar portion 327A of support bracket 327. If the cantilever length is taken from a spot weld location to the distal end of doctor blade 309, weld pattern 501 provides for a substantially constant cantilever length across the width of doctor blade 309.

Figure 6:
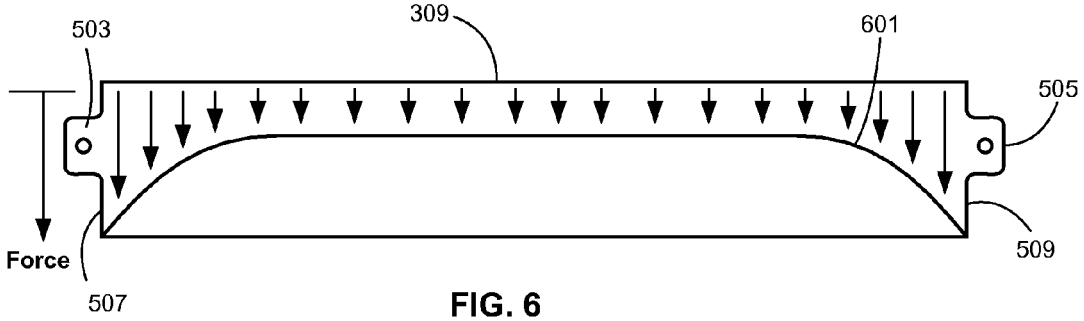
FIG. 6 shows the force distribution of the doctor blade of FIG. 5.

FIG. 6 shows the force distribution profile 601 of the doctor blade 309 having the weld pattern shown in FIG. 5. As shown, the farther the weld is from a longitudinal end of the doctor blade 309, the less magnitude of force the doctor blade applies to the developer roll 307. Thus, there exists an inconsistent distribution of forces across the developer roll 307. As previously mentioned, when the coating of toner on the developer roll 307 is not consistent, the printed image quality may suffer. To provide a more consistent distribution of forces, it has been contemplated that the weld line pattern should take the shape substantially opposite that of the force distribution. In an example embodiment shown in FIG. 7, there is shown a spot weld pattern 701 following a curved, substantial U-shape. However, although weld pattern 701 relatively closely corresponds to the force distribution along the doctor blade 309, following the curved weld pattern 701 can increase manufacturing costs. In an alternative embodiment shown in FIG. 8, the spot weld pattern includes an upper weld line 801 and a lower weld line 802. The upper weld line 801 has a plurality of spot welds forming two spaced apart line segments 801A, 801B, each positioned adjacent the longitudinal ends 807, 809. The lower weld line 802 has of a plurality of spot welds formed in a more central region of doctor blade 309, between the upper weld line segments 801A, 801B. It is understood that other weld patterns may be used in other embodiments. Both weld patterns 701 and 801 provide for varying cantilever lengths across the width of the doctor blade 309.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable unit for an electrophotographic imaging device, comprising:

a housing having an opening;

a rotatable roll disposed near the opening and adjacent to a bottom of the housing; and a blade assembly coupled to the housing, comprising a support bracket secured to a wall defining at least a part of the opening of the housing, and a blade member coupled to the support bracket and being positioned in the removable unit so that a distal end portion of the blade member engages with the rotatable roll;

wherein the housing, the blade assembly, and a portion of a surface of the rotatable roll define a substantially sealed enclosure for containing toner therein, wherein the support bracket includes a first surface against which the blade member is coupled, the first surface having an upper portion, a central portion and a lower portion, the blade member being coupled to the central portion of the first surface and wherein the blade member bends away from the lower portion of the first surface of the support bracket due to engagement with the rotatable roll so as to form a gap between the lower portion of the first surface of the support bracket and the blade member such that the lower portion of the first surface of the support bracket does not contact the blade member, the upper portion, central portion and lower portion of the first surface are a single planar or substantially planar surface, and wherein the blade member is attached to the support bracket at a plurality of attachment points along a width of the blade member, and a distance between the attachment points and a lower portion of the first surface of the support bracket is greater near first and second ends of the blade member than at the central portion thereof along the width of the blade member.

2. The removable unit of claim 1, wherein the support bracket comprises a top ledge disposed along a top thereof.

3. The removable unit of claim 2, wherein the blade member extends substantially from the top ledge of the support bracket to the distal end portion of the blade member, thereby providing a continuous, substantially smooth surface for enclosing the housing.

4. The removable unit of claim 1, further comprising a seal disposed between the wall defining at least part of the opening of the housing and the blade assembly, the seal contacting the distal end portion of the blade member.

5. The removable unit of claim 1, wherein cantilever length of the blade member is longer near the first and second ends than at a location near the central portion along the width of the blade member, the cantilever length of the blade member being a distance between an attachment point of the blade member to the support bracket and the distal end portion of the blade member.

6. The removable unit of claim 1, wherein the plurality of attachment points comprise a plurality of weld locations and the blade member is attached to the support bracket at the plurality of weld locations along the width of the blade member, and the weld locations comprise a plurality of spot weld locations such that the blade member and the support bracket are welded together and the spot weld locations forming a weld pattern along the blade member and support bracket, the weld pattern providing a varying cantilever length of the blade member along the width thereof, the cantilever length of the blade member being the distance between the weld location of the blade member and the distal end portion of the blade member.

7. The removable unit of claim 1, wherein the first surface of the support bracket is vertical or substantially vertical.

8. A removable unit for an electrophotographic imaging device, comprising:

a housing for containing toner and being formed with an opening that extends along a width of the housing;

a rotatable roll disposed near the opening and adjacent to a bottom wall of the housing; and a blade assembly coupled to the housing, comprising a support bracket secured along the opening of the housing, the support bracket having a first surface comprising an upper portion, a central portion and a lower portion, a blade member coupled to and contacting the central portion of the first surface of the support bracket and being positioned so that a distal end portion of the blade member engages with the rotatable roll, the first surface being a single planar or substantially planar surface;

wherein contact between the blade member and the roll causes the blade member to bend away from a lower portion of the first surface of the support bracket so as to form a gap between the lower portion of the first surface of the support bracket and the blade member such that the lower portion of the first surface of the support bracket does not contact the blade member, and wherein the blade member and support bracket are welded together at a plurality of weld locations forming a weld pattern along the blade member and support bracket, the weld pattern providing a varying cantilever length of the blade member along the width thereof, the cantilever length of the blade member being the distance between the weld location of the blade member and the distal end portion of the blade member, and the weld pattern being nonlinear across the width of the blade member.

9. The removable unit of claim 8, wherein the support bracket extends across a width of the blade assembly and contacts the housing along an upper edge of the opening thereof.

10. The removable unit of claim 9, wherein the blade member extends substantially from a top portion of the support bracket to the distal end portion engaging the rotatable roll thereby providing a continuous, substantially smooth surface for enclosing the housing.

11. The removable unit of claim 10, wherein the support bracket includes a top ledge extending from an upper area thereof.

12. The removable unit of claim 11, wherein the support bracket further includes a bottom ledge extending from a lower area thereof in a substantially opposite direction from a direction the top ledge extends from the support bracket, the support bracket having a substantially Z-shaped cross section.

13. The removable unit of claim 8, wherein a distance between the weld pattern and a lower end of the first surface of the support bracket varies in at least two locations across the width of the blade member.

14. The removable unit of claim 13, wherein the weld pattern includes a first pattern portion and a second pattern portion, at least one of the first pattern portion and the second pattern portion being nonlinear.

15. A blade assembly for an imaging system, comprising:

a blade member having a first surface and a longitudinal width defined between a first end and a second end; and a bracket member having a having a first surface, the bracket member and the blade member being attached together such that the first surface of the blade member is adjacent the first surface of the bracket member;

wherein the blade member is attached to the bracket member at a plurality of attachment points across the width of the blade member, a distance between the attachment points and the lower end of the bracket member varies along the width thereof such that a cantilever length of the blade member near the central portion thereof is less than the cantilever length of the blade member near the first and second ends of the blade member, the cantilever length of the blade member being a distance between the attachment points to the bracket member and a distal end portion of the blade member.

16. The blade assembly of claim 15, wherein the distance between the attachment points and the lower end of the bracket member one of generally gradually decreases and abruptly decreases in a direction from at least one of the first and second ends of the blade member towards the central portion thereof such that the cantilever length of the blade member the one of generally gradually decreases and abruptly decreases in a direction from at least one of the first and second ends of the blade member towards the central portion thereof.

17. The blade assembly of claim 15, wherein blade member is welded to the support bracket, weld locations near at least one of the first and second ends of the blade member form a first substantially linear weld pattern, and weld locations at the central portion of the blade member form a second substantially linear weld pattern, the first and second substantially linear weld patterns being substantially parallel with each other.

18. The blade assembly of claim 15, wherein the bracket member includes a first ledge disposed along a top of the bracket member, the first ledge forming an angle with the first surface thereof.

19. The blade assembly of claim 18, wherein the bracket member includes a second ledge disposed along a bottom of the bracket member, the second ledge extending in a direction from the first surface of the bracket member that is substantially opposite a direction the first ledge extends from the first surface of the bracket member, the bracket member forming a substantially Z-shaped cross-section.

20. The removable unit of claim 15, wherein the attachment point pattern includes a first pattern portion and a second pattern portion, at least one of the first pattern portion and the second pattern portion being substantially linear.

21. The removable unit of claim 20, wherein each of the first pattern portion and the second pattern portion is linear.

22. The blade assembly of claim 15, wherein the blade member, relative to the bracket member, bends away from the bracket member upon application of force so as to form a gap between the blade member and an end of the bracket member in which the bracket member does not contact the blade member.

23. The blade assembly of claim 15, wherein the first surface of the bracket member is a single surface that is planar or substantially planar.

24. A removable unit for an electrophotographic imaging device, comprising:

a housing for containing toner and being formed with an opening that extends along a width of the housing;

a rotatable roll disposed near the opening and adjacent to a bottom wall of the housing; and a blade assembly coupled to the housing, comprising a support bracket secured along the opening of the housing, a blade member coupled to a first surface of the support bracket and being positioned so that a distal end portion of the blade member engages with the rotatable roll;

wherein contact between the blade member and the roll causes the blade member to bend away from the lower portion of the first surface of the support bracket so as to form a gap between the lower portion of the first surface of the support bracket and the blade member such that the lower portion of the first surface of the support bracket does not contact the blade member, and wherein the blade member and support bracket are welded together at a plurality of weld locations forming a weld pattern along the blade member and support bracket, the weld pattern providing a varying cantilever length of the blade member along the width thereof, the cantilever length of the blade member being the distance between the weld location of the blade member and the distal end portion of the blade member, and the weld pattern being nonlinear across the width of the blade member.

25. A removable unit for an electrophotographic imaging device, comprising:

a housing for containing toner and being formed with an opening that extends along a width of the housing;

a rotatable roll disposed near the opening and adjacent to a bottom wall of the housing; and a blade assembly coupled to the housing, comprising a support bracket secured along the opening of the housing, the support bracket having a first surface comprising an upper portion, a central portion and a lower portion, a blade member coupled to and contacting the central portion of the first surface of the support bracket and being positioned so that a distal end portion of the blade member engages with the rotatable roll, the first surface being a single planar or substantially planar surface;

wherein contact between the blade member and the roll causes the blade member to bend away from a lower portion of the first surface of the support bracket so as to form a gap between the lower portion of the first surface of the support bracket and the blade member such that the lower portion of the first surface of the support bracket does not contact the blade member, wherein the blade member is attached to the support bracket at a plurality of attachment points along a width of the blade member, the blade member has a cantilever length which is a distance between an attachment point of the blade member to the support bracket and the distal end portion of the blade member, wherein the attachment points form an attachment point pattern extending substantially across the width of the blade member, and a distance between the attachment point pattern and a lower end of the first surface of the support bracket varies in at least two locations across the width of the blade member, and wherein the attachment point pattern includes a first pattern portion and a second pattern portion, at least one of the first pattern portion and the second pattern portion being nonlinear.

* * * * *